US011840917B2

(12) United States Patent
Aty et al.

(10) Patent No.: US 11,840,917 B2
(45) Date of Patent: Dec. 12, 2023

(54) MAGNETIC DOWNHOLE MONITORING SYSTEM

(71) Applicant: Saudi Arabian Oil Company, Dhahran (SA)

(72) Inventors: Adel Y. Aty, Dammam (SA); Abdulmalek Sulaiman Almatrodi, Dammam (SA); Majed Muhamad Alkishi, Dammam (SA); Suliman Mansour Alodhiani, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/697,106

(22) Filed: Mar. 17, 2022

(65) Prior Publication Data

US 2023/0296016 A1 Sep. 21, 2023

(51) Int. Cl.

| | |
|---|---|
| ***E21B 47/01*** | (2012.01) |
| ***E21B 17/02*** | (2006.01) |
| ***E21B 47/13*** | (2012.01) |

(52) U.S. Cl.

CPC ..... *E21B 47/01* (2013.01); *E21B 17/028* (2013.01); *E21B 47/13* (2020.05)

(58) Field of Classification Search

CPC ..... E21B 47/13; E21B 17/028; E21B 47/00; E21B 47/01

See application file for complete search history.

(56) References Cited

U.S. PATENT DOCUMENTS

| | | | | |
|---|---|---|---|---|
| 2007/0221407 | A1 | 9/2007 | Bostick et al. | |
| 2014/0238669 | A1* | 8/2014 | Odashima | E21B 47/01 166/250.11 |
| 2016/0084062 | A1 | 3/2016 | Negre | |
| 2018/0305993 | A1* | 10/2018 | Perkins | E21B 47/00 |
| 2020/0400012 | A1* | 12/2020 | Lanticq | E21B 47/09 |
| 2021/0350953 | A1* | 11/2021 | Nicolas | E21B 17/028 |

* cited by examiner

*Primary Examiner* — Brad Harcourt
(74) *Attorney, Agent, or Firm* — Fish & Richardson P.C.

(57) ABSTRACT

A magnetic downhole monitoring system includes a sensor configured to be lowered into a wellbore and to sense a well parameter. The sensor is housed in a magnetic material. A magnetic joint is configured to be attached to an inner surface of a wellbore tubular installed within a wellbore completion. The magnetic joint is configured to be electromagnetically activated to attract and attach to the sensor. A power cable is configured to be lowered into an annulus between the wellbore completion and the wellbore tubular. The power cable is configured to provide power through the wellbore tubular to electromagnetically activate the magnetic joint.

18 Claims, 3 Drawing Sheets

MAGNETIC DOWNHOLE MONITORING SYSTEM

TECHNICAL FIELD

This disclosure relates to wellbores, and particularly to sensors deployed within wellbores.

BACKGROUND

Hydrocarbons (e.g., petroleum, natural gas, combinations of them) entrapped in subsurface reservoirs are raised to the surface through wellbores formed from a surface of the Earth to the subsurface reservoirs through subterranean zones (e.g., a formation, a portion of a formation, multiple formations). When producing wellbore fluids through the wellbores, parameters including well parameters representing properties of the wellbore, flow parameters representing flow properties of the wellbore fluids and fluid parameters representing fluid properties of the wellbore fluids need to be periodically monitored. Doing so ensures efficient production through the wellbore as well as safety and stability of the wellbore. Sensors are often deployed at different locations on a well site including within the wellbore (e.g., at the surface, at different depths, on well completions, on the wellbore wall or floor). Readings from the deployed sensors are used to monitor the well site, and particularly the wellbore.

SUMMARY

This disclosure relates to magnetic downhole monitoring systems, e.g., systems that can be deployed and retrieved using wirelines or slicklines without the need for rigs.

Certain aspects of the subject matter described here can be implemented as a wellbore sensor system. The system includes a sensor configured to be lowered into a wellbore and to sense a well parameter. The sensor is housed in a magnetic material. A magnetic joint is configured to be attached to an inner surface of a wellbore tubular installed within a wellbore completion. The magnetic joint is configured to be electromagnetically activated to attract and attach to the sensor. A power cable is configured to be lowered into an annulus between the wellbore completion and the wellbore tubular. The power cable is configured to provide power through the wellbore tubular to electromagnetically activate the magnetic joint.

An aspect combinable with any other aspect includes the following features. The sensor has a hollow, annular body configured to allow wellbore fluids to flow through the sensor when the sensor is attached to the magnetic joint.

An aspect combinable with any other aspect includes the following features. A side wall of the sensor defines openings for the wellbore fluids to flow through when the sensor is attached to the magnetic joint.

An aspect combinable with any other aspect includes the following features. A wireline or a slickline is attached to the sensor to lower the sensor into the wellbore tubular.

An aspect combinable with any other aspect includes the following features. A power source is installed at a surface of the wellbore. The power source is operatively coupled to the power cable to transmit power through the power cable.

An aspect combinable with any other aspect includes the following features. The power cable includes a data cable configured to receive, through the wellbore tubular, the well parameter sensed by the sensor and to transmit the received well parameter to the surface of the wellbore.

An aspect combinable with any other aspect includes the following features. The magnetic joint is a first magnetic joint attached to the inner surface of the wellbore tubular at a first depth within the wellbore. The wellbore sensor system includes multiple magnetic joints including the first magnetic joint. Each of the multiple magnetic joints is configured to be attached to the inner surface of the wellbore tubular at respective depths within the wellbore. Each of the multiple magnetic joints is configured to be electromagnetically activated to attract and attach to the sensor.

An aspect combinable with any other aspect includes the following features. The power cable extends from a surface of the wellbore to a magnetic joint installed at a lowest depth within the wellbore. The power cable is configured to provide power through the wellbore tubular to electromagnetically activate each of the multiple magnetic joints.

Certain aspects of the subject matter described here can be implemented as a method. A magnetic joint is attached to an inner surface of a wellbore tubular. The magnetic joint is configured to be electromagnetically activated to attract and attach to a sensor in a proximity of the magnetic joint. The wellbore tubular is installed within a wellbore completion installed in the wellbore to form an annulus between the wellbore completion and the wellbore tubular. A sensor is lowered into the wellbore tubular. The sensor is housed in a magnetic material. The sensor is configured to sense a well parameter. The magnetic joint is electromagnetically activated from the annulus. The sensor is attracted and attaches to the magnetic joint in response to electromagnetically activating the magnetic joint.

An aspect combinable with any other aspect includes the following features. To electromagnetically activate the magnetic joint from the annulus, a power cable is lowered into the annulus to a depth of the magnetic joint. The power cable is configured to provide power through the wellbore tubular to electromagnetically activate the magnetic joint. The power is transmitted through the power cable to activate the magnetic joint.

An aspect combinable with any other aspect includes the following features. A power surface is installed at a surface of the wellbore. The power source is configured to transmit power. The power cable is operatively coupled to the power source.

An aspect combinable with any other aspect includes the following features. The power cable includes a data cable configured to receive, through the wellbore tubular, the well parameter sensed by the sensor and to transmit the received well parameter to the surface of the wellbore. The well parameter sensed by the sensor is received through the wellbore tubular. The well parameter is transmitted to the surface of the wellbore through the data cable.

An aspect combinable with any other aspect includes the following features. The magnetic joint is a first magnetic joint. The first magnetic joint is attached to the inner surface of the wellbore tubular at a first location that corresponds to a first depth within the wellbore. Multiple magnetic joints are attached to corresponding multiple locations on the inner surface of the wellbore. Each of the multiple locations corresponds to a depth of multiple depths within the wellbore. Each of the multiple magnetic joints is configured to be electromagnetically activated to attract and attach to the sensor.

An aspect combinable with any other aspect includes the following features. After installing the wellbore tubular within the wellbore completion, the power cable is extended from the surface of the wellbore to a magnetic joint installed at a lowest depth within the wellbore. After lowering the sensor into the wellbore tubular, a magnetic joint of the multiple magnetic joints to which the sensor is to be attached is identified. Power is transmitted through the power cable to the identified magnetic joint.

An aspect combinable with any other aspect includes the following features. The sensor is lowered into the wellbore tubular using a slickline or wireline.

An aspect combinable with any other aspect includes the following features. The magnetic joint is electromagnetically activated from the annulus while producing wellbore fluids through the wellbore.

An aspect combinable with any other aspect includes the following features. The sensor has a hollow, annular body. The wellbore fluids are flowed through the body of the sensor when the sensor is attached to the magnetic joint.

An aspect combinable with any other aspect includes the following features. A side wall of the sensor defines openings for the wellbore fluids to flow through. The wellbore fluids are flowed through the openings in the side wall.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a magnetic downhole monitoring system (MDMS) that can be run inside (i.e., lowered into and retrieved from) any wellbore with a wellbore completion (e.g., a production tree, a production tubing) utilizing a slickline or a wireline, and without needing a rig. As described in detail below, the MDMS includes a sensor with a magnetic body that can magnetically attach to any location on an inside surface of a wellbore tubular installed within the wellbore completion. The magnetic force required to hold the MDMS in place is produced by electromagnetism generated in a magnetic joint that is installed as part of the wellbore completion. Magnetism in the magnetic joint is generated by powering the magnetic joint using a power cable that runs into the wellbore outside the wellbore tubular, e.g., in an annulus between the tubular and the wellbore completion. In some implementations, the sensor can communicate sensed data (e.g., well parameters, wellbore fluid parameters, wellbore fluid flow parameters or similar sensed data) wirelessly to the surface without the need for data transmission cables. Alternatively or in addition, the sensor can communicate the sensed data through a data cable that is included in the power cable.

Implementing the techniques described here allows deploying components of the MDMS as part of the wellbore completion, but negates a need to remove the entire wellbore completion to replace or repair components of the MDMS. Instead, the magnetic sensor can be deployed or retrieved using a wireline or slickline without needing a rig. If the sensor cannot be retrieved using the wireline or slickline (e.g., because the wireline or slickline breaks), then the magnetic sensor can be allowed to fall into the wellbore and fished out with other wellbore debris. In case there is a power failure and the sensor falls, the tubing can have a profile that can hold the sensor and prevent it from falling further in the hole. The profile can be a part of the magnetic joint or can be completely separate from the magnetic joint.

Figure 1A:
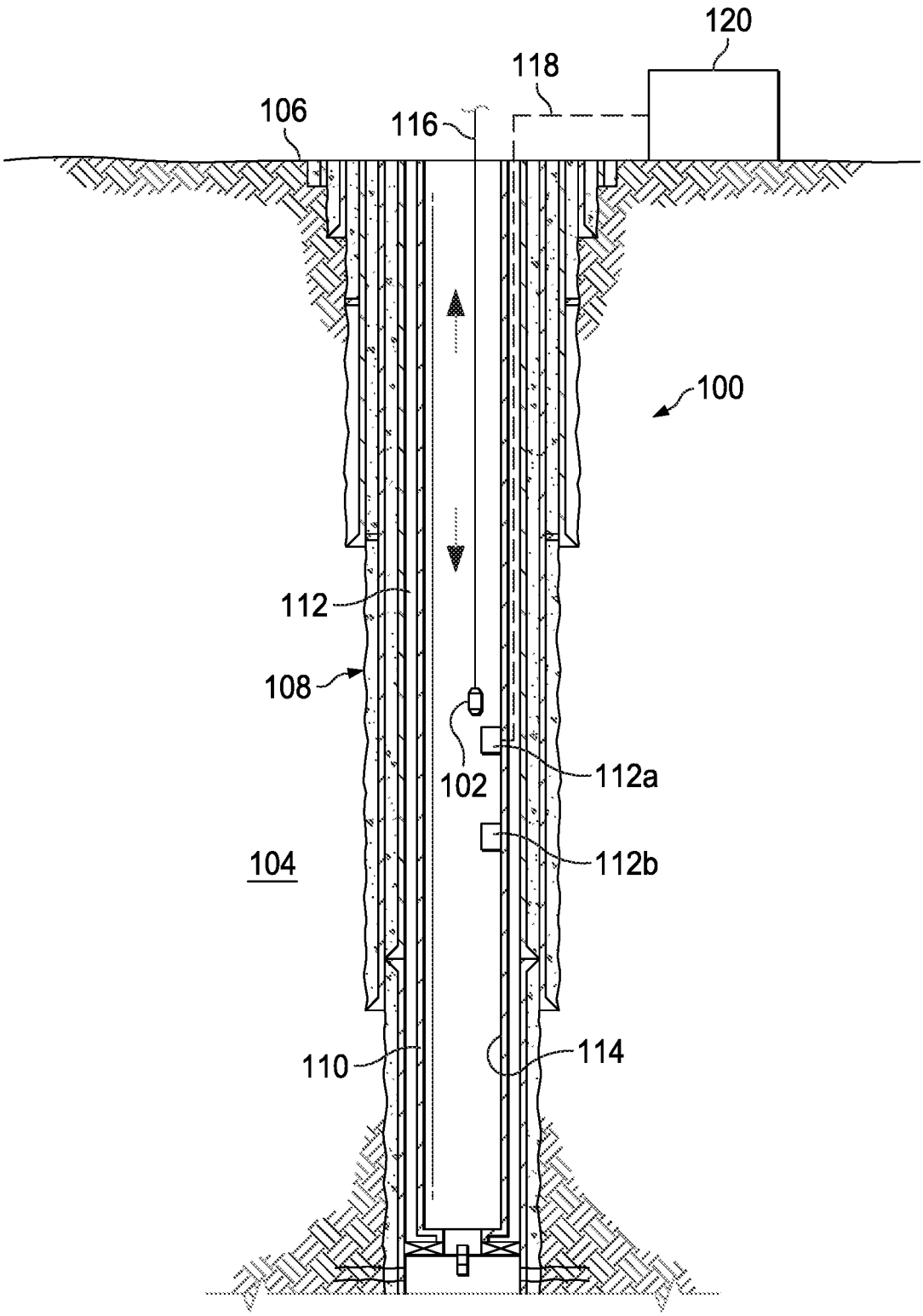
FIG. 1A is a schematic diagram of a wellbore into which a sensor has been lowered.

FIG. 1A is a schematic diagram of a wellbore 100 into which a sensor 102 (described below) has been lowered. The wellbore 100 is formed in a subterranean zone 104 extending from a surface 106 to a subsurface reservoir (not shown) in which hydrocarbons are entrapped. The wellbore is cased and a wellbore completion 108 is installed within the wellbore 100. The wellbore completion 108 includes multiple wellbore tubulars and other wellbore equipment that are usually disposed within a wellbore to prepare a wellbore for production. In some instances, the wellbore completion 108 can include multiple, telescoping tubulars originating at the surface 106 or other location within the wellbore 100 and extending into the wellbore 100. In some implementations, the wellbore 100 can be uncased.

A wellbore tubular 110 is installed within the wellbore 100, specifically within the wellbore completion 108. To do so, the wellbore tubular 110 can be lowered into the wellbore completion 108 using a rig or using coiled tubing. In some implementations, the wellbore tubular 110 can be a component of the wellbore completion 108. The bottom end, i.e., the downhole end, of the wellbore tubular 110 is open to receive wellbore fluids (e.g., production fluids like hydrocarbons) to be produced to the surface 106. In a cased wellbore, an outer surface of the wellbore tubular 110 and an inner surface of the wellbore completion 108 define an annulus 112. In an uncased wellbore, the annulus is defined by the outer surface of the wellbore tubular 110 and an inner wall of the wellbore.

One or more magnetic joints (e.g., a first magnetic joint 112*a*, a second magnetic joint 112*b* or more magnetic joints) can be attached (e.g., adhered to, screwed on or physically connected in any manner) to an inner surface 114 of the wellbore tubular 110 Each magnetic joint is attached at a particular location in the wellbore tubular 110 such that each location corresponds to a respective depth within the wellbore 100 after the wellbore tubular 110 is installed within the wellbore completion 108. Each magnetic joint is a metallic block made of a material that can be electromagnetically activated to magnetically attract and attach to the sensor 102 (described below). For example, each magnetic joint is made of steel or a similar metal or material which, in response to receiving electric current, generates a magnetic field. In addition, each magnetic joint is made of a material that can receive power from an outside of the wellbore tubular 110 and through the wellbore tubular 110 wall. In some implementations, the material with which the magnetic joint is made can receive signals sensed by the sensor 102 and transfer the signals through the wellbore tubular 110 wall. In some implementations, the magnetic joint can include (e.g., can be embedded with) an electromagnet. In general, any material that can pass an electrical current through or that can be magnetized by supplying electrical energy can be used to make the magnetic joint. The surface of the magnetic joint can be formed so that as much surface area of the magnetic joint as possible contacts the inner surface 114 of the wellbore tubular 110. For example, the surface of the magnetic joint can be curved with a radius of curvature that matches that of the inner surface 114 of the wellbore tubular 110. Similarly, a surface of the magnetic joint opposite the surface that attaches to the inner surface 114 of the wellbore tubular 110 can have a shape that complements the shape of the sensor 102 so that as much surface area of the magnetic joint as possible contacts the sensor 102 when the sensor 102 is attached to the magnetic joint.

Figure 2:
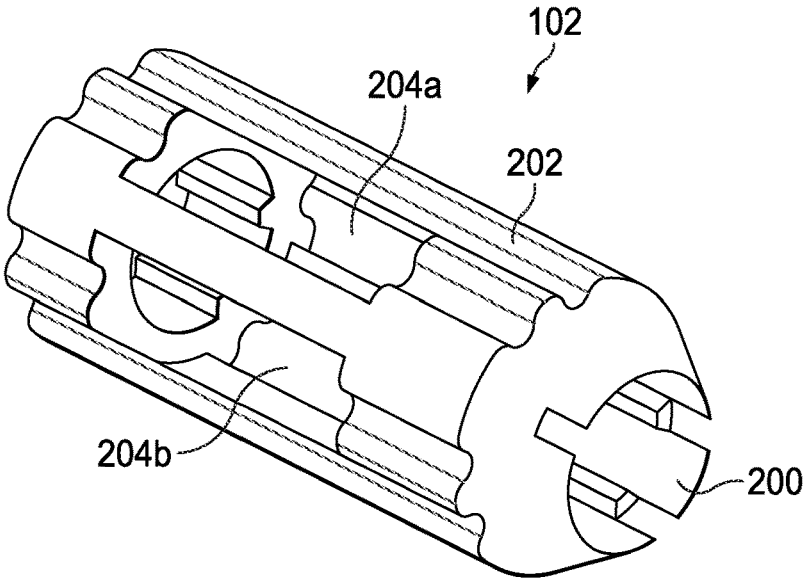
FIG. 2 is a schematic diagram of the sensor.

FIG. 2 is a schematic diagram of the sensor 102. In some implementations, the sensor 102 has a body that defines a hollow, annular portion 200. When disposed within the wellbore 100, the hollow, annular portion 200 allows wellbore fluids to flow. In some implementations, the body includes a side wall 202 that defines openings (e.g., a first opening 204*a*, a second opening 204*b*, and more or fewer similar openings) to further allow the wellbore fluids to flow through. In general, a shape and construction of the sensor 102 can be such that wellbore production remains substantially unaffected when the sensor 102 is installed within the wellbore 100. The body of the sensor 102 can include guides to orient the sensor 102 to connectors. The hollow, annular portion 200 allows well intervention (e.g., using coil tubing or wirelines) and also allows wellbore fluids to pass through. In some implementations, the sensor 102 can be housed within the body to protect the sensor from the parameters within the wellbore 100 (e.g., temperature and pressure of the wellbore 100, wellbore fluid parameters such as flow rate, pressure, corrosive nature of the wellbore fluids, and similar parameters within the wellbore 100). Alternatively, the sensor 102 can be made of a material that has the properties of the body.

Returning to FIG. 1A, the sensor 102 can be lowered into the wellbore 100 and can sense one or more parameters (e.g., well parameters, wellbore fluid parameters, wellbore fluid flow parameters or similar parameters associated with any aspect of the wellbore). In some implementations, the sensor 102 is housed in a magnetic material. Alternatively or in addition, the sensor 102 can be made of magnetic material. For example, the sensor 102 can be a temperature sensor, a pressure sensor, a flow rate sensor, a vibration sensor, a sensor that senses a type of fluid, or similar sensor that can sense observable parameters within the wellbore 100, specifically when producing wellbore fluids. In response to sensing a well parameter, the sensor 102 can generate a signal (e.g., a data signal or electromagnetic signal) representative of the sensed well parameter, and transmit the generated signal.

In some implementations, the sensor 102 can be lowered into (or raised out of) the wellbore 100, specifically into the wellbore completion 108 on a wireline or slickline 116. By using the wireline or the slickline 116, an operator controls a depth to which the sensor 102 is lowered into the wellbore completion 108.

As described above, the magnetic joint 112*a* is electromagnetically activated to generate a magnetic field in response to receiving electric power. To provide the power to the magnetic joint 112*a*, a power cable 118 is lowered into the wellbore 100, specifically in the annulus 112. That is, whereas the magnetic joint 112*a* is installed within the wellbore tubular 110, the power cable 118 to power the magnetic joint 112*a* to generate the electromagnetic field is run into the wellbore 110 outside the wellbore tubular 110 in the annulus 112. For example, the power cable 118 can be spooled at the surface 106 and run into the annulus 112. An end of the power cable 118 can be attached to a power source 120 (e.g., a battery, a generator, or similar power source that can generate electrical power) installed at the surface 106. The power source 120 can transmit power (e.g., a voltage or a current) through the power cable 118. The end of the power cable 118 is positioned at the same or substantially the same depth as the magnetic joint 112*a*, but outside the wellbore tubular 110. Through induction, the magnetic joint 112*a* can receive the power through the wellbore tubular 110, and, in response, generate the electromagnetic field. Alternatively or in addition, wet mate connectors can be used to supply power directly to the sensor while isolating the electrical circuit from wellbore fluids. The power cable 118 can be fed through a small tubing that is run along the production tubing on the outer side. The small tubing can be permanently disposed within the wellbore, and the power cable 118 can be fed into and pulled out of the permanently installed tubing.

When operations are performed in the wellbore 100 as shown schematically in FIG. 1A, the sensor 102 is lowered into the wellbore tubular 110. Power is not yet transmitted through the power cable 118. Or, if power is transmitted, then the sensor 102 is not yet within a range of the electromagnetic field generated by the magnetic joint 112*a*. Consequently, the sensor 102 is detached from the magnetic joint 112*a*.

Figure 1B:
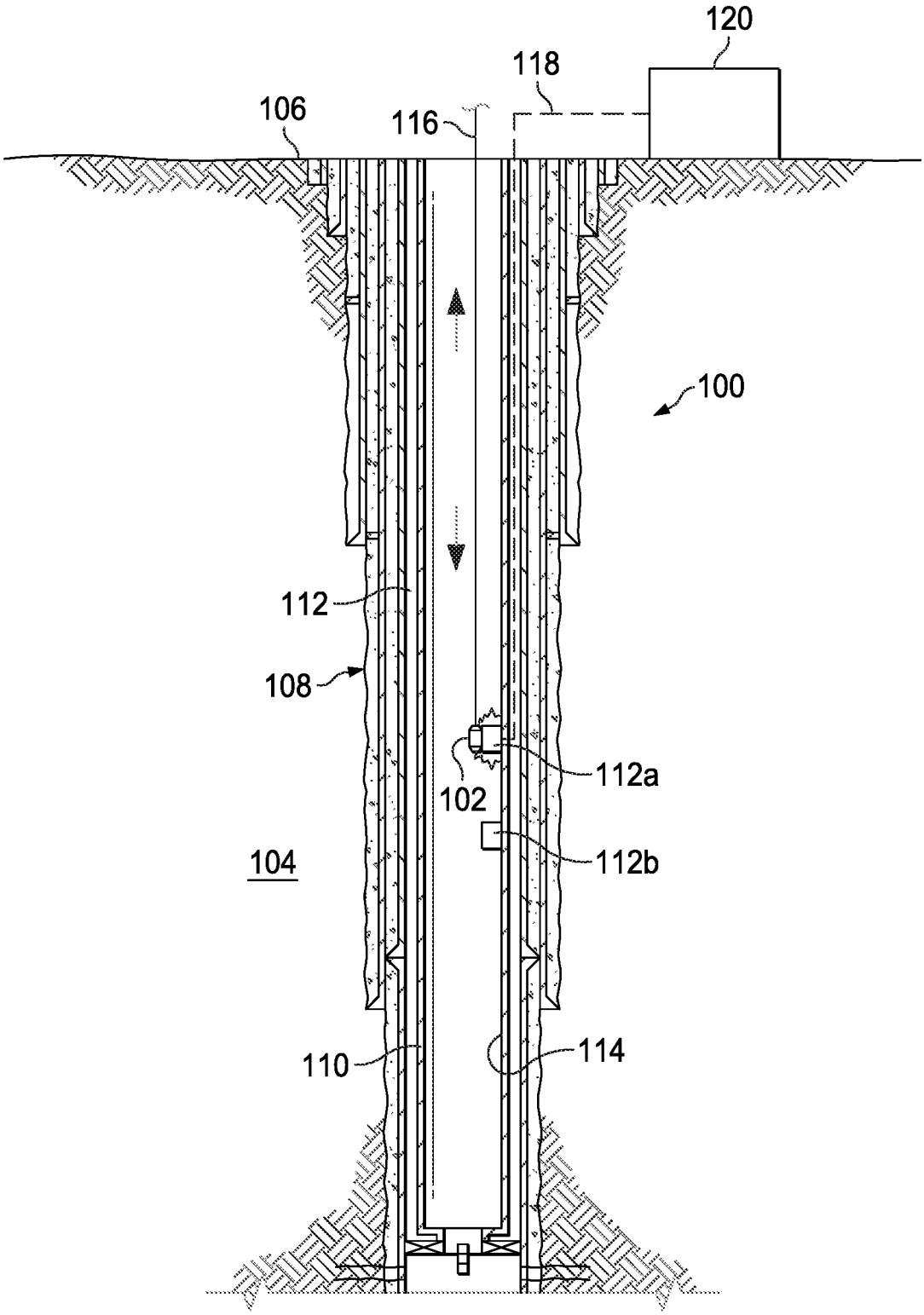
FIG. 1B is a schematic diagram of the wellbore in which the sensor is attached a magnetic joint.

FIG. 1B is a schematic diagram of the wellbore in which the sensor 102 is attached a magnetic joint 112*a*. When the sensor 102 is lowered to a depth where the sensor 102 is within a range of the electromagnetic field, the sensor 102 is attracted to and attaches to the magnetic joint 112*a*. A degree of attachment between the sensor 102 and the magnetic joint 112*a* depends on a strength of the electromagnetic field. The strength of the electromagnetic field, in turn, depends on a quantity of power transmitted through the power cable 118. Therefore, by controlling the quantity of power transmitted through the power cable 118, a degree of attachment between the sensor 102 and the magnetic joint 112*a* can be controlled. For example, the degree of attachment needs to be strong enough such that the sensor 102 does not get detached from the magnetic joint 112*a* by a force of the wellbore fluid flowing through and past the sensor 102 within the wellbore 100. In addition to selecting a power source 120 that can provide an amount of power needed to achieve the necessary degree of attachment, an appropriate power cable 118 that can transmit that amount of power can also be selected.

With the sensor 102 attached to the magnetic joint 112*a* due to the electromagnetic field generated by the magnetic joint 112*a*, parameters within the wellbore 100 sensed by the sensor 102 are transmitted to the surface 106, e.g., to a receiver (not shown). In some implementations, the sensed well parameters can be transmitted wirelessly to the surface 106. In some implementations, the sensed well parameters can be transmitted by telemetry using the wellbore fluids flowing through the wellbore 100. In some implementations, the power cable 118 includes a data cable that can receive sensed data from the sensor 102. For example, the data cable can receive the sensed data through the wellbore tubular 110 (e.g., as induction signals) and transmit the sensed signals as data signals to a receiver (not shown), which can be housed in the same housing as the power source 120. In some implementations, the data cable can received the sensed data through wet mate connectors described above.

In implementations in which multiple magnetic joints (e.g., magnetic joints 112*a*, 112*b*) are installed at different depths in the wellbore tubular 110, the same sensor 102 can be used at different times to sense well parameters at the different depths. For example, by stopping power transmission through the power cable 118, the electromagnetic field generated by the magnetic joint 112*a* can be turned off. In response, the sensor 102 detaches from the magnetic joint

112*a* and is free to be lowered (or raised) within the wellbore tubular 110. In the example schematics shown in FIGS. 1A and 1B, the wireline or slickline 116 can lower the sensor 102 to the depth of the magnetic joint 112*b*.

In some implementations, the power cable 118 can also be lowered to the depth of the magnetic joint 112*b*. Upon reaching the depth, power can be transmitted through the power cable 118 to the magnetic joint 112*b* to activate the electromagnetic field. In response, the sensor 102 is attracted to and attaches to the magnetic joint 112*b*, and the sensing processes can be repeated. In some implementations, the power cable 118 can extend from the surface through the annulus 104 to the magnetic joint disposed at the lowest depth within the wellbore tubular 110. Multiple induction pads (or similar power transmission equipment) can be installed at different locations on the power cable, each location corresponding to a depth of a respective magnetic joint. In such implementations, each magnetic joint can be independently activated to generate an electromagnetic field by transmitting power to the induction pad (or power transmission equipment) at the depth of that magnetic joint. Similarly, sensed data can be collected from each magnetic joint and transmitted to the surface. In this manner, parameters within the wellbore 100 can be sensed at different wellbore depths.

Figure 3:
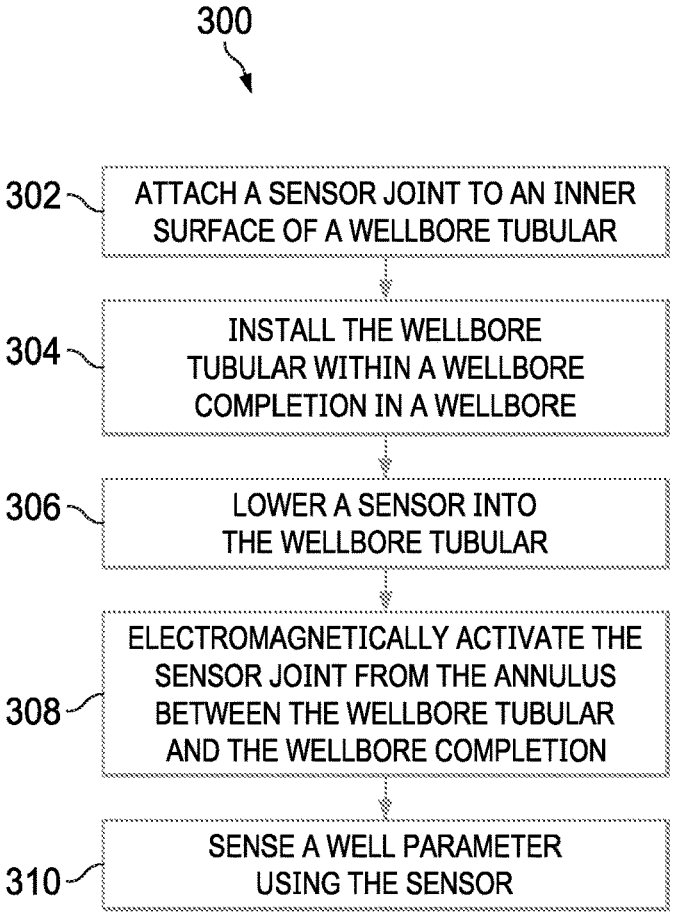
FIG. 3 is a flowchart of an example of a method of using the sensor to monitor well parameters.

FIG. 3 is a flowchart of an example of a method 300 of using the sensor to monitor well parameters. At 302, a magnetic joint (e.g., the magnetic joint 112*a*) is attached to an inner surface of a wellbore tubular (e.g., the wellbore tubular 110). For example, the attachment can be performed outside a wellbore. At 304, the wellbore tubular is installed within a wellbore completion in a wellbore (e.g., the wellbore completion 108 of the wellbore 100). At 306, a sensor (e.g., the sensor 102) is lowered into the wellbore tubular. As described earlier, the sensor is made of or housed in a magnetic material, and can sense a well parameter. At 308, the magnetic joint is electromagnetically activated from the annulus formed by the wellbore tubular and the wellbore completion. To do so, the power cable transmits power through the wellbore tubular and to the magnetic joint. The magnetic joint generate an electromagnetic field which attracts the sensor. The sensor is attached to the magnetic joint. At 310, a well parameter is sensed with the sensor. For example, the sensor can be instantly activated to sense the well parameter when power is supplied to the magnetic joint.

Thus, particular implementations of the subject matter have been described. All components described here as being disposed, installed or operated within a wellbore can be designed and constructed to operate as intended under wellbore conditions in the presence or absence of wellbore fluids. The disclosure described wellbore sensing operations performed during production when production fluids flow from a downhole end of the wellbore toward a surface. The wellbore sensing operations can be performed during other wellbore operations, e.g., wellbore drilling or operations when wellbore fluids from the surface toward the downhole end. The wellbore sensing operations can also be performed when the wellbore fluid is stationary within the wellbore or when no fluid is present in the wellbore. Other implementations are within the scope of the following claims.

What is claimed is:

1. A wellbore sensor system comprising:

a sensor configured to be lowered into a wellbore and to sense a well parameter, the sensor housed in a magnetic material;

a magnetic joint configured to be attached to an inner surface of a wellbore tubular installed within a wellbore completion, the magnetic joint configured to be electromagnetically activated to attract and attach to the sensor; and a power cable configured to be lowered into an annulus between the wellbore completion and the wellbore tubular, the power cable configured to provide power through the wellbore tubular to electromagnetically activate the magnetic joint.

2. The wellbore sensor system of claim 1, wherein the sensor has a hollow, annular body configured to allow wellbore fluids to flow through the sensor when the sensor is attached to the magnetic joint.

3. The wellbore sensor system of claim 2, wherein a side wall of the sensor defines openings for the wellbore fluids to flow through when the sensor is attached to the magnetic joint.

4. The wellbore sensor system of claim 1, further comprising a wireline or a slickline attached to the sensor to lower the sensor into the wellbore tubular.

5. The wellbore sensor system of claim 1, further comprising a power source installed at a surface of the wellbore, the power source operatively coupled to the power cable to transmit power through the power cable.

6. The wellbore sensor system of claim 5, wherein the power cable comprises a data cable configured to receive, through the wellbore tubular, the well parameter sensed by the sensor and to transmit the received well parameter to the surface of the wellbore.

7. The wellbore sensor system of claim 1, wherein the magnetic joint is a first magnetic joint attached to the inner surface of the wellbore tubular at a first depth within the wellbore, wherein the wellbore sensor system comprises a plurality of magnetic joints including the first magnetic joint, each of the plurality of magnetic joints configured to be attached to the inner surface of the wellbore tubular at respective depths within the wellbore, each of the plurality of magnetic joints configured to be electromagnetically activated to attract and attach to the sensor.

8. The wellbore sensor system of claim 7, wherein the power cable extends from a surface of the wellbore to a magnetic joint installed at a lowest depth within the wellbore, wherein the power cable is configured to provide power through the wellbore tubular to electromagnetically activate each of plurality of magnetic joints.

9. A method comprising:

attaching a magnetic joint to an inner surface of a wellbore tubular, the magnetic joint configured to be electromagnetically activated to attract and attach to a sensor in a proximity of the magnetic joint;

installing the wellbore tubular within a wellbore completion installed in the wellbore to form an annulus between the wellbore completion and the wellbore tubular;

lowering a sensor into the wellbore tubular, the sensor housed in a magnetic material, the sensor configured to sense a well parameter;

electromagnetically activating the magnetic joint from the annulus, wherein the sensor is attracted and attaches to the magnetic joint in response to electromagnetically activating the magnetic joint.

10. The method of claim 9, wherein electromagnetically activating the magnetic joint from the annulus comprises:

lowering a power cable into the annulus to a depth of the magnetic joint, the power cable configured to provide power through the wellbore tubular to electromagnetically activate the magnetic joint; and transmitting the power through the power cable to activate the magnetic joint.

11. The method of claim 10, further comprising:

installing a power source at a surface of the wellbore, the power source configured to transmit power; and operatively coupling the power cable to the power source.

12. The method of claim 10, wherein the power cable comprises a data cable configured to receive, through the wellbore tubular, the well parameter sensed by the sensor and to transmit the received well parameter to the surface of the wellbore, wherein the method comprises:

receiving, through the wellbore tubular, the well parameter sensed by the sensor; and transmitting the well parameter to the surface of the wellbore through the data cable.

13. The method of claim 9, wherein the magnetic joint is a first magnetic joint, wherein the first magnetic joint is attached to the inner surface of the wellbore tubular at a first location that corresponds to a first depth within the wellbore, wherein the method comprises attaching a plurality of magnetic joints to a corresponding plurality of locations on the inner surface of the wellbore tubular, wherein each of the plurality of locations corresponds to a depth of a plurality of depths within the wellbore, each of the plurality of magnetic joints configured to be electromagnetically activated to attract and attach to the sensor.

14. The method of claim 13, further comprising:

after installing the wellbore tubular within the wellbore completion, extending the power cable from the surface of the wellbore to a magnetic joint installed at a lowest depth within the wellbore; and after lowering the sensor into the wellbore tubular:

identifying a magnetic joint of the plurality of magnetic joints to which the sensor is to be attached, and transmitting power through the power cable to the identified magnetic joint.

15. The method of claim 9, wherein lowering the sensor into the wellbore tubular comprises lowering the sensor using a slickline or wireline.

16. The method of claim 9, wherein electromagnetically activating the magnetic joint from the annulus comprises electromagnetically activating the magnetic joint while producing wellbore fluids through the wellbore.

17. The method of claim 16, wherein the sensor has a hollow, annular body, wherein the method comprises flowing the wellbore fluids through the body of the sensor when the sensor is attached to the magnetic joint.

18. The method of claim 17, wherein a side wall of the sensor defines openings for the wellbore fluids to flow through, wherein the method comprises flowing the wellbore fluids through the openings in the side wall.

* * * * *